US007140173B2

(12) United States Patent
Van Rooij

(10) Patent No.: US 7,140,173 B2
(45) Date of Patent: Nov. 28, 2006

(54) METHOD AND DEVICE FOR ASSEMBLING AN ENDLESS CHAIN, IN PARTICULAR A TRANSMISSION CHAIN

(75) Inventor: Jacques Van Rooij, Nuenen (NL)

(73) Assignee: Gear Chain Industrial B.V. (NL)

( * ) Notice: Subject to any disclaimer, the term of this patent is extended or adjusted under 35 U.S.C. 154(b) by 294 days.

(21) Appl. No.: 10/793,208

(22) Filed: Mar. 4, 2004

(65) Prior Publication Data

US 2005/0193712 A1 Sep. 8, 2005

(51) Int. Cl.
*B21L 9/06* (2006.01)
*F16G 13/06* (2006.01)

(52) U.S. Cl. ..... 59/7; 59/35.1; 474/229; 29/251

(58) Field of Classification Search ..... 29/251, 29/525.01; 100/292; 474/229, 230; 59/7, 59/11, 35.1

See application file for complete search history.

(56) References Cited

U.S. PATENT DOCUMENTS 2,831,316 A * 4/1958 Linde, Jr. ..... 59/7
2,971,253 A * 2/1961 Berglund ..... 29/234
3,802,184 A * 4/1974 Brown et al. ..... 59/7
3,866,410 A * 2/1975 Zwinge ..... 59/4
3,943,702 A * 3/1976 Lacombe-Allard ..... 59/4
4,235,073 A * 11/1980 Tracy ..... 59/11
4,878,345 A * 11/1989 Bechtold ..... 59/15
5,728,021 A * 3/1998 van Rooij et al. ..... 474/229

FOREIGN PATENT DOCUMENTS

DE 41 12 804 A1 10/1992
DE 197 27 845 A1 1/1999
EP 0 741 255 A1 11/1996

* cited by examiner

*Primary Examiner*—David Jones
(74) *Attorney, Agent, or Firm*—Ostrolenk, Faber, Gerb & Soffen, LLP

(57) ABSTRACT

A method as well as a device for assembling a transmission chain made up of sets of two elongated elements which lie with their long sides against each other and are coupled in pairs to each other by link plates with openings of which chain one supports the sets in accommodating holes formed in a support, whereafter two adjacent sets of elements are coupled together by placing a link plate on them. The device has a supporting assembling body with holes for two adjacent longitudinal elements, each hole having a depth less than the element's length.

5 Claims, 4 Drawing Sheets

METHOD AND DEVICE FOR ASSEMBLING AN ENDLESS CHAIN, IN PARTICULAR A TRANSMISSION CHAIN

BACKGROUND OF THE INVENTION

The invention relates to a method for assembling an endless chain, in particular a transmission chain, built up of individual sets, each of two elongated elements with their long sides lying against each other. The sets are coupled to each other in pairs by link plates provided with openings corresponding to those sets.

Producing chains of this kind in the customary way is done using large lengths from which a piece having a length corresponding to the circumference of the desired length to be made is detached from the remaining length. The devices, necessary for making a chain this way, are complicated and expensive.

SUMMARY OF THE INVENTION

The object of the present invention is to provide a method as described above which has the advantage that it can be carried out manually as well as automated. According to the invention this method is carried out in such a way that the respective sets are supported parallel to each other in a number accommodating holes arranged in a closed circle and in a support, each hole having a depth less than the length of the elements and subsequently-in accordance with a desired pattern-two sets lying next to each other are coupled together by placing a link plate thereon until the part protruding from the support has been provided with link plates over a desired length. The subassembly obtained in this way can be detached from the support. If wanted, this subassembly can then be turned over and the remaining link plates can be placed on the remaining free parts of the longitudinal elements in accordance with the pattern desired.

Using the method described above a complete chain is thus made in one cycle consisting of a number of simple assembly steps. The number of specialized tools necessary for carrying out this method is minimal whereas the fact that the link plates only have to be placed on the elongated elements over a limited length (for example, no greater than half of this length) simplifies the method.

Preferably, the method is carried out so that the longest of these two elements is supported at a level that lies below the level at which the shortest element is supported. Because of this, there is the advantage that the ends of the shorter elements will already directly lie at practically the same distance from the ends of the longer elements in the completed chain.

Another object of the invention is to provide a device for carrying out the method described above. This device comprises, according to the invention, a supporting assembling body with a closed ring of holes in it corresponding to the dimensions of the chain to be assembled. Each hole has a cross-section adapted to a configuration of a combination of two longitudinal elements lying next to each other and having a depth less than the length thereof. Each hole is bounded on the top side by two raised edges situated radially at a distance from each other and is on the bottom side closed off by a stepped recess, so that each longest element is inserted in a hole over a greater distance than the same of the shorter element.

For a more complete understanding of the method and set-up for assembling an endless chain, in particular a transmission chain of the present invention, reference is made to the following detailed description and accompanying drawings in which the presently preferred embodiments of the invention are illustrated by way of example. That the invention may be embodied in several forms without departing from the spirit or essential characteristics thereof, it is expressly understood that the drawings are for purposes of illustration and description only, and are not intended as a definition of the limits of the invention. Throughout the following description and drawings, identical reference numbers refer to the same component throughout the several views.

DETAILED DESCRIPTION OF THE INVENTION

Figure 1:
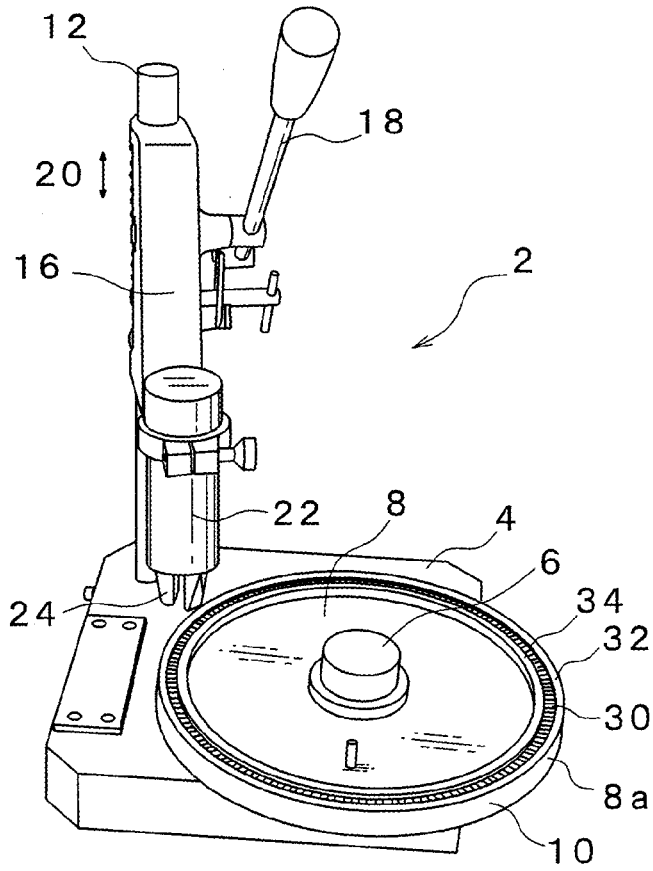
FIG. 1 is a perspective view from above of the device according to the invention.
Figure 2:
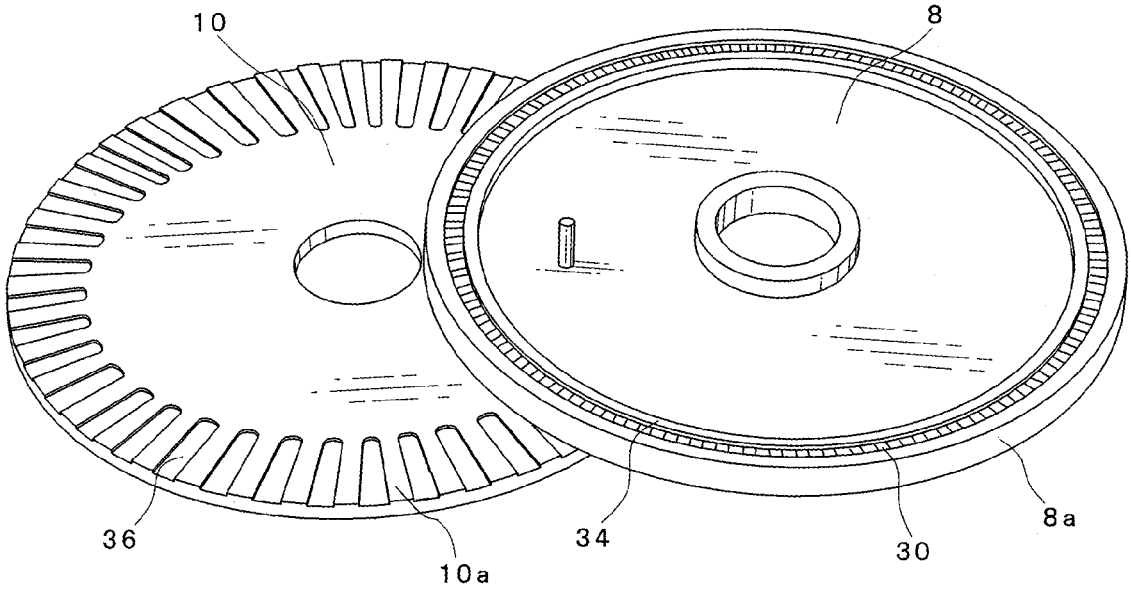
FIG. 2 is a perspective view of the assembling body and its corresponding closing plate.

FIG. 1 shows a complete device for assembling a transmission chain using the method according to the invention. This device, indicated in its entirety by the number 2, consists of a base 4 from which a spindle 6 protrudes. An assembling plate 8 and a closing plate 10, shown in detail in FIG. 2, can rotate about the spindle 6. Furthermore, the device 2 comprises an upright column 12 along which an arm 16 is guided that can be moved up and down by means of a simple mechanism, driven by an operating lever 18 in the direction of the arrows 20. There is a gripper head 22 situated on the free end of the arm 16 with jaws 24 with which a link plate can be pressed onto a set of the elongated chain elements.

As the figures show, near the outer periphery 8*a* of the assembling plate 8 (which indeed could also be an assembling ring) there is a ring of axial openings 30 for inserting those sets situated between the plate's raised outer edge 32 and a raised inner edge 34. Each of these openings has a configuration which corresponds to the outer contour of a set of two elongated elements of the transmission chain to be assembled, each with their long sides lying against each other, as elucidated in detail in FIGS. 3 and 4. The upper surface 10*a* of the closing plate 10 to be placed under the assembling plate 8 is provided with a number of radial, shallow, recesses 36 the width of which corresponds to the thickness of the longest elongated elements of the chain.

Figure 3:
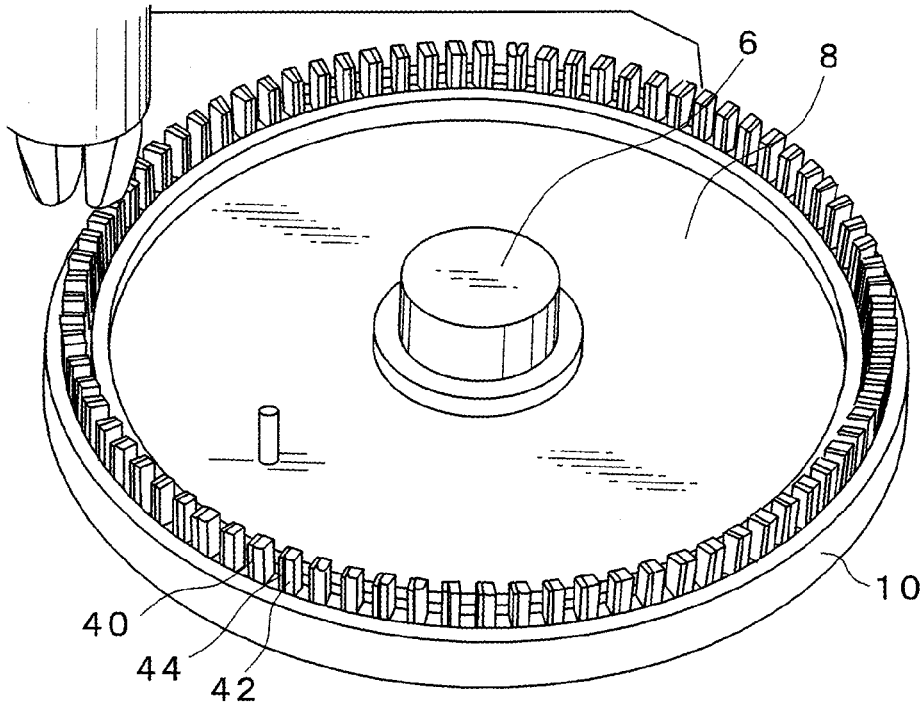
FIG. 3 is a perspective view of sets of elongated elements placed in the assembling body.

As FIG. 3 shows, firstly the closing plate 10 and then the assembly plate 8 are placed around the spindle 6 and in such a position with regard to each other that the recessed grooves 36 in the closing plate 10 lie under the holes 30 in which the longest of the elements are inserted. This can, of course, be realized in a simple manner. Because the method and set-up according to the invention are intended in particular for assembling a transmission chain of the type described in the European patent EP 0741255 and the U.S. Pat. No. 5,728,021 respectively, both in the name of the applicant, a set of elongated transmission elements, indicated in FIGS. 3 and 4 by the number 40, will consist of a long pin 42 and a slightly shorter roll-off strip 44. During use, the longer pins 42 are in contact with the tapered cone pulleys and realize the transmission of power to the link plates, a few of which are shown in detail in FIG. 4 and are indicated by the numeral 46. Always the combination of a pin 42 and a strip 44 is placed in a take-up opening 30, where the pin 42 will come to lie a little lower than the strip because the end of the pin will fit into the radial recess 36.

Figure 4:
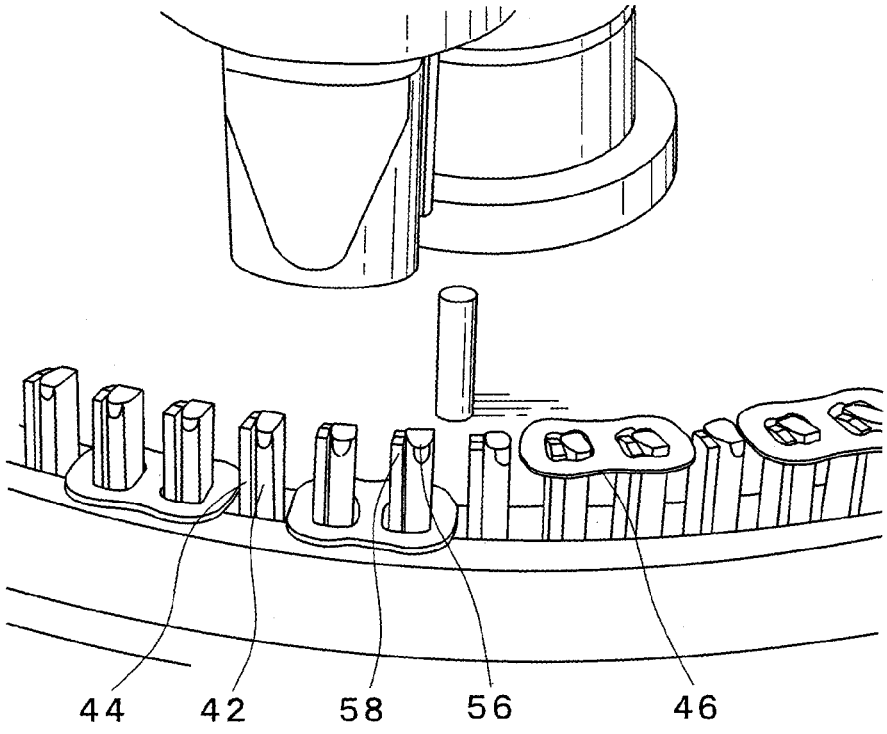
FIG. 4 is an enlarged detail from FIG. 3.
Figure 5:
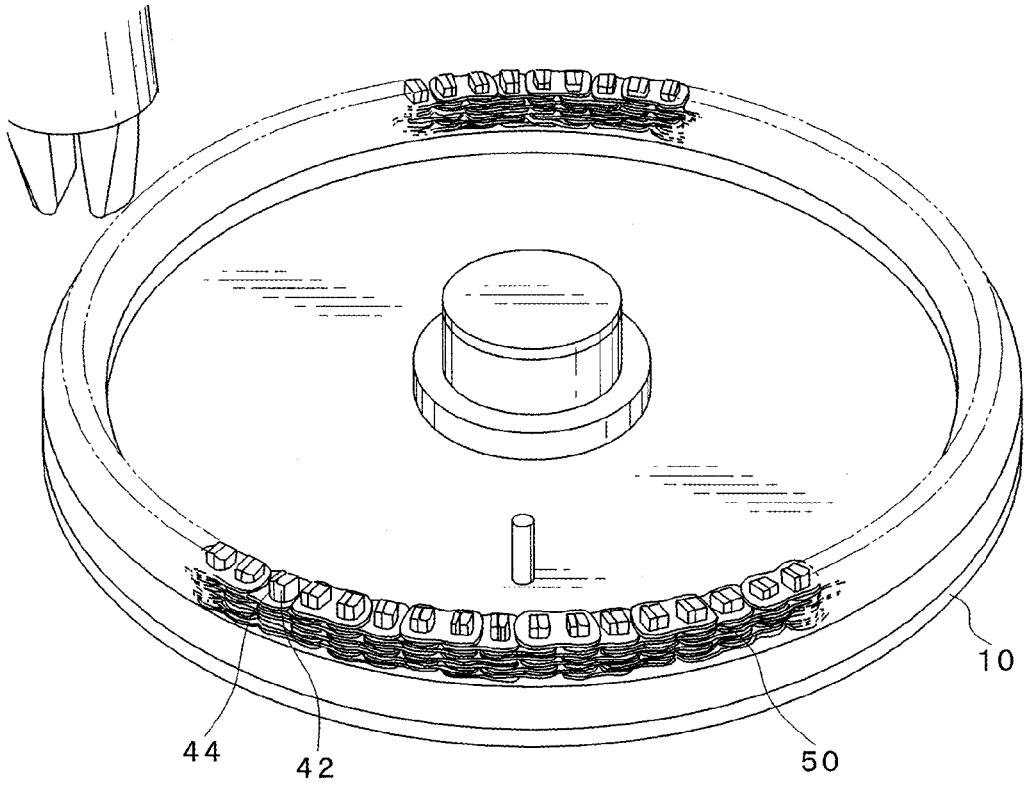
FIG. 5 shows a chain made on the assembling body in a semi-assembled state.

FIG. 3 shows the situation in which all the sets of pins and strips have been placed in the assembling plate and FIG. 4 shows the start of the phase wherein the link plates 46 are being placed on the pins 42 and strips 44. This takes place in accordance with the pattern desired and can easily be done manually or be carried out mechanically. In the embodiment shown, the link plates are pressed onto the sets of pins and strips by the jaws 24 during the downward movement of the lever 18. FIG. 5 shows the situation in which the transmission chain is halfway assembled; the upper part of each set of pins and strips is coupled to the adjoining set by a link plate.

Figure 6:
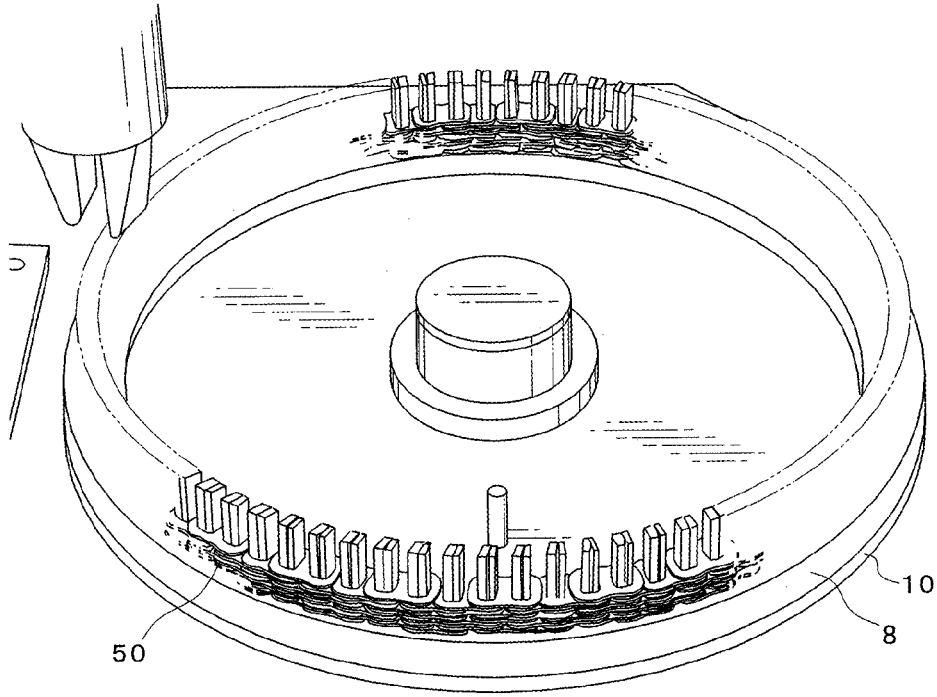
FIG. 6 shows the assembling body with the turned-over, semi-assembled chain resting on it.
Figure 7:
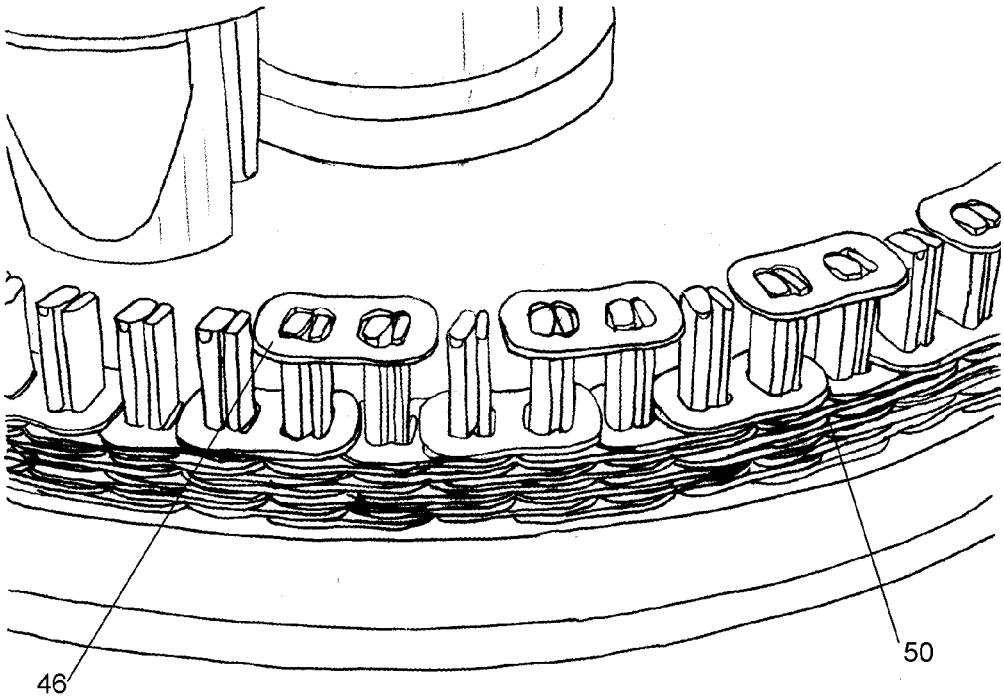
FIG. 7 shows a detail from FIG. 6.
Figure 8:
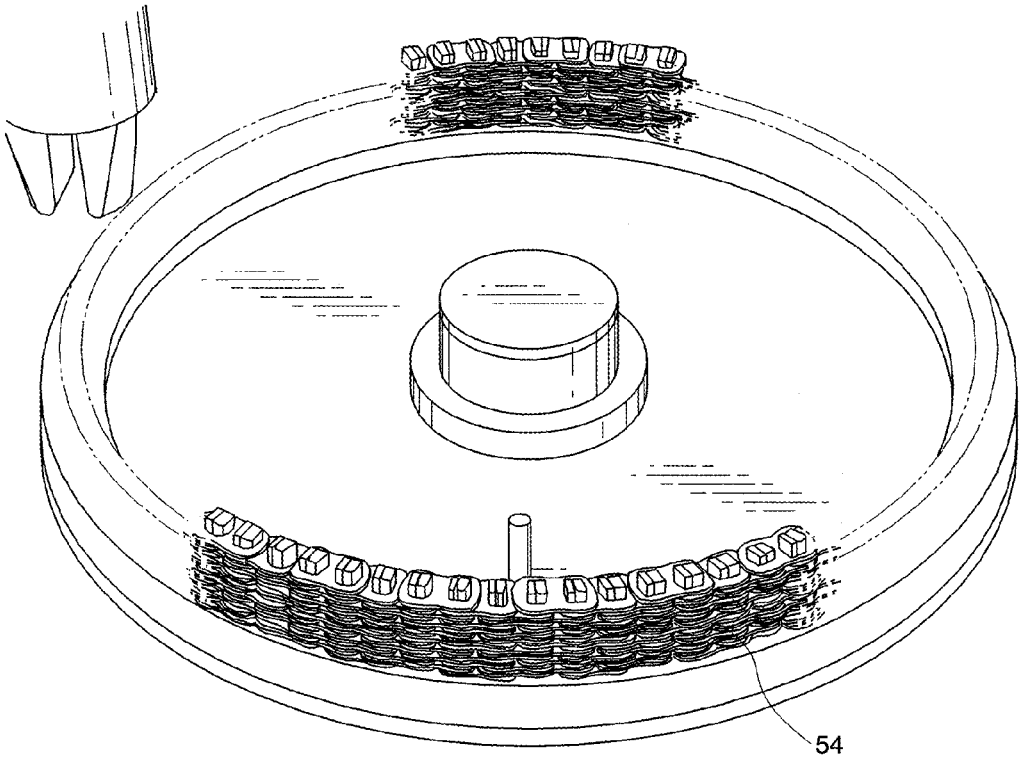
FIG. 8 shows the fully assembled chain.

The subassembly 50 obtained in this way is now detached from the assembly plate 8, turned over and again put on the assembling plate 8: this is the situation in FIG. 6. The purpose of the raised edges at the periphery 32 and 34 respectively is now also apparent; they enclose in between them the protruding ends of the pins and strips protruding from the subassembly 50 which has already been made, as a result of which the subassembly remains in position. FIG. 7 shows how the first link plates 46 will complete the subassembly which has already been made and finally FIG. 8 shows the finished transmission chain 54.

FIG. 4 in particular shows a favorable detail of the configuration of pins and strips respectively and particularly the bevel 56 and 58 respectively on the head-end which makes it easier to place the link plates over the sets of pins and strips, especially when the pins and strips are coupled to the link plates with a light drive press-fit.

While the method and set-up for assembling an endless chain, in particular a transmission chain has been described in conjunction with specific embodiments, it is evident that many alternatives, modifications and variations will be apparent to those skilled in the art in light of the disclosure herein. It is intended that the meets and bounds of the invention be determined by the appended claims rather than by the language of the above specification, and that all such alternatives, modifications and variations which form a function or co-jointly or cooperative equivalent are intended to be included within he spirit and scope of these claims.

The invention claimed is:

1. A method for assembling an endless transmission chain built up of individual sets, each set having two elongated elements and long sides lying against each other, the sets being coupled to each other in pairs by link plates provided with openings corresponding to those sets, the method comprising the steps of:

supporting respective sets of the elements parallel to each other in a number of accommodating holes arranged in a closed circle in a support, each hole having a depth less than a length of the elements;

respectively coupling together two sets lying next to each other in accordance with a desired pattern by placing a link plate thereon until that part of the elements protruding from the support has been provided with link plates along a desired length; and subsequently detaching the assembly from the support.

2. The method according to claim 1, further comprising turning the assembly over and placing further link plates on remaining free parts of the longitudinal elements in accordance with a desired pattern.

3. The method according to claim 1, wherein in each set of elongated elements one of the elements is always shorter than the other of the elements, the longest of these two elements being supported at a level that lies below a level at which the shortest element is supported.

4. A device for carrying out a method for assembling an endless transmission chain built up of individual sets, each set having two elongated elements with respective long sides lying against each other, the sets being coupled to each other in pairs by link plates provided with openings corresponding to those sets, wherein in each set of elongated elements one of the elements is always shorter than the other of the elements, the longest of these two elements being supported at a level that lies below a level at which the shortest element is supported, the device comprising a supporting assembling body with a closed ring of holes therein corresponding to measurements of the chain to be assembled, each hole having a cross-section adapted to a configuration of a combination of two longitudinal elements of the chain lying next to each other, and with a depth less than its length, each hole being bounded on a top side by two raised edges situated radially at a distance from each other and being closed on a bottom side by a stepped recess, so that each longest element is insertable in a hole over a distance greater than a distance of the shorter element.

5. The device according to claim 4, wherein the stepped recesses are formed in a separate plate which abuts to a bottom side of the body comprising the respective holes for inserting the elements.

* * * * *